US005287908A

United States Patent [19]

Hoffmann et al.

[11] Patent Number: 5,287,908

[45] Date of Patent: Feb. 22, 1994

[54] WINDOW COVERING ASSEMBLY

[75] Inventors: Brian M. Hoffmann, Westminster; Wendell B. Colson, Boulder; Eric N. Williams, Louisville, all of Colo.

[73] Assignee: Hunter Douglas Inc., Upper Saddle River, N.J.

[21] Appl. No.: 810,331

[22] Filed: Dec. 19, 1991

[51] Int. Cl.[5] ..... E06B 9/08

[52] U.S. Cl. ..... 160/121.1; 160/133; 160/265

[58] Field of Search ..... 160/121.1, 133, 319, 160/321, 322, 265, 271, 274, 89, 345

[56] References Cited

U.S. PATENT DOCUMENTS

| | | | |
|---|---|---|---|
| 286,027 | 10/1883 | Lobdell . | |
| 718,992 | 1/1903 | Emery . | |
| 1,121,898 | 12/1914 | Davis | 160/265 |
| 1,958,695 | 5/1934 | Claus . | |
| 2,029,675 | 2/1936 | Schlamp . | |
| 2,056,823 | 10/1936 | Brown | 160/133 |
| 2,110,145 | 3/1938 | Loehr | 160/89 |
| 2,140,049 | 12/1938 | Grauel . | |
| 2,267,869 | 12/1941 | Loehr | 160/133 X |
| 2,620,850 | 12/1952 | Janowski . | |
| 2,688,356 | 9/1954 | Conti . | |
| 2,822,840 | 2/1958 | Reynolds . | |
| 2,834,412 | 11/1958 | Velke . | |
| 2,865,446 | 12/1958 | Cole . | |
| 2,914,122 | 11/1959 | Pinto | 160/89 |
| 2,994,370 | 8/1961 | Pinto | 160/89 |
| 3,371,702 | 3/1968 | Keegan et al. . | |
| 3,384,519 | 5/1968 | Froget . | |
| 3,386,489 | 6/1968 | Denton et al. | 160/322 X |
| 3,421,276 | 1/1969 | LaBarge . | |
| 3,509,934 | 5/1970 | Smart . | |
| 3,661,665 | 5/1972 | Froget . | |
| 3,701,376 | 10/1972 | Froget | 160/121 |
| 3,708,009 | 1/1973 | Viol . | |
| 3,783,931 | 1/1974 | Assael . | |
| 4,019,554 | 4/1977 | Rasmussen | 160/84.1 |
| 4,182,088 | 1/1980 | Ball . | |
| 4,202,395 | 5/1980 | Heck et al. . | |
| 4,344,474 | 8/1982 | Berman . | |
| 4,434,834 | 3/1984 | Ennes . | |
| 4,473,101 | 9/1984 | Langeler . | |
| 4,519,434 | 5/1985 | Forquer . | |
| 4,647,488 | 3/1987 | Schnebly . | |
| 4,673,018 | 6/1987 | Judkins . | |
| 4,687,038 | 8/1987 | Clemente . | |
| 4,694,543 | 9/1987 | Conley . | |
| 4,732,630 | 3/1988 | Schnebly . | |
| 4,799,299 | 1/1989 | Campbell . | |
| 4,862,941 | 9/1989 | Colson . | |
| 4,885,190 | 12/1989 | Schnebly . | |
| 4,912,900 | 4/1990 | Yeamans . | |
| 5,002,628 | 3/1991 | Schnebly . | |
| 5,070,924 | 12/1991 | Bateman . | |

FOREIGN PATENT DOCUMENTS

| | | |
|---|---|---|
| 220074 | 4/1987 | European Pat. Off. . |
| 382758 | 5/1922 | Fed. Rep. of Germany . |
| 122088 | 4/1900 | Fed. Rep. of Germany . |
| 1241361 | 5/1967 | Fed. Rep. of Germany . |
| 8906284 | 9/1989 | Fed. Rep. of Germany . |
| 319458 | 3/1902 | France . |
| 847779 | 10/1939 | France . |
| 1309194 | 10/1962 | France . |
| 1321456 | 2/1963 | France . |
| 1373515 | 4/1964 | France . |
| 6508988 | 1/1967 | Netherlands . |
| 7805464 | 10/1979 | Netherlands . |
| 951484 | 3/1964 | United Kingdom . |
| 1036126 | 7/1966 | United Kingdom . |
| 1116934 | 6/1968 | United Kingdom . |

*Primary Examiner*—David M. Purol

*Attorney, Agent, or Firm*—Gary M. Polumbus

[57] ABSTRACT

A window covering including first and second sheer fabrics interconnected by a plurality of transversely extending vanes is disclosed. The sheer fabrics are connected to circumferentially spaced apart fixing elements on a wind up roll which is mounted with its longitudinal axis extending generally horizontally to one side of a frame of a skylight. Associated with the wind up roll at each end are cord reels and a control pulley at one end of a respective cord reel. Rotation of the wind up roll is effected by operation of a cord wrapped around the control pulley. Wrapped around the cord reels are tension cords which pass around fixed pulleys and are connected to opposite ends of an end rail having in its interior a tension spring to the end of which are attached the ends of the tension cords. Two parallel tracks extending generally perpendicular to the wind up roll is provided for guiding the end rail.

15 Claims, 3 Drawing Sheets

WINDOW COVERING ASSEMBLY

BACKGROUND TO THE INVENTION

The present invention relates to a window covering assembly. Thee are many known forms of window covering assembly including curtains, roller blinds, venetian blinds and the like. Recently there has been proposed a window covering assembly which includes first and second generally parallel spaced apart longitudinally extending sheer fabrics having a plurality of longitudinally spaced generally parallel transversely extending vanes fixedly secured to the first and second sheer fabrics to extend therebetween.

The sheer fabrics are often constructed of a translucent or transparent material and may be in the form of actual fabrics or non-woven fabrics or indeed may simply sheets of plastics material. The vanes are usually opaque or semi-opaque and by adjusting the relative positions of the sheer fabrics, the vanes can be caused to tilt relative to one another rather in the manner of the slats of a venetian blind. Conventionally such assemblies have a bottom rail and the vanes extend horizontally, the sheer fabrics being supported on a tilt roll which can also be used as a wind up roll.

The use of such window covering assemblies is, however, somewhat limited.

SUMMARY OF THE INVENTION

It is a primary object of the present invention to provide greater diversity of use of the aforesaid general type of window covering and yet provide a structure which is relatively inexpensive.

It is now proposed, according to one aspect of the invention, to provide a window covering assembly comprising, in combination:

a) a window covering comprising:
   i) first and second generally parallel spaced apart, longitudinally extending, sheer fabrics, each having one end and an opposite end; and
   ii) a plurality of longitudinally spaced, generally parallel, transversely extending vanes, fixedly secured to said first and second sheer fabrics to extend therebetween;

b) a carrier member connected to said one end of said first fabric; and c) an end rail connected to said opposite end of said second fabric, said end rail and said carrier member being movable towards and away from each other, whereby variation of the distance between said carrier member and said end rail effective to after the angle of said vanes relative to said sheer fabrics when said window covering is in its expanded state.

More specifically, according to one embodiment the invention provides a window covering assembly comprising, in combination:

a) wind up roll means rotatable about its longitudinal axis;

b) first and second fixing means on said roll means, said second fixing means being circumferentially spaced on said roll means from said first fixing means;

c) a window covering comprising:
   i) first and second generally parallel spaced apart, longitudinally extending, sheer fabrics, each having one end and an opposite end, said one ends being fixed to said first and second fixing means respectively, and
   ii) a plurality of longitudinally spaced, generally parallel, transversely extending vanes, fixedly secured to said first and second sheet fabrics to extend herebetween; and d) an end rail connected to the opposite end of one of said sheer fabrics, said end rail being movable towards and away from said wind up roll means, initial rotation of said roll means causing said first and second sheer fabrics to move longitudinally relative to one another, effective to alter the angle of said vanes relative to said sheer fabrics, and further rotation to said roll means winding said window covering onto said roll means.

With such a structure, by connecting the wind up roll means to one of the first and second sheer fabrics, and the end rail to the other, it is readily possible to operate the roll in itself to effect a "tilting" motion of the slats and yet use the same assembly to wind up the blind. It is contemplated that the blind could be operated with the wind up roll and the end rail horizontal so that the blind may be used to cover a skylight in either a horizontal ceiling or in an inclined roof. With such a structure it is convenient to provide first and second cord reels carried at opposite ends of the wind up reel, first and second pulleys mountable beyond the ends of the end rail, when the end rail is furthest from the wind up roll, first and second tension cords being connected to the first and second cord reels respectively, effective to be wound up thereon when said roll is rotated to wind up the window covering, the first and second tension cords passing around the first and second fixed pulleys and being connected to opposite ends of the end rail, means being provided to apply tension to the tension cords. In this way it is possible to cause the end rail to move in either direction by operation of the wind up means in one direction of rotation or the other. The means to apply tension may comprise a tension spring mounted in the end rail, opposite ends of the first and second tension cords being attached to the tension spring.

It is also contemplated that the window covering assembly could be used in a manner of a sliding door in which case a cord reel is carried by the wind up roll at the upper end thereof, and a fixed pulley is mountable beyond the end rail, when the end rail is furthest from the wind up roll, the tension cord being connected to the cord reel effective to be wound up thereon when the cord reel is rotated to wind up the window covering, the tension cord passing around the fixed pulley and then connected to the end rail, means being provided to apply tension to the tension cord, means further being provided to mount the wind up roll so that it axially extends substantially vertically, a top guide track extending horizontally from the upper end of the wind up roll means, a sliding carrier axially slidable in the top track, said end rail also extending substantially vertically and having its upper end connected to the sliding carrier, whereby when the wind up means is operated to wind up the window covering, the end rail is moved longitudinally along the track. As indicated previously, this movement can be in either direction depending on the direction of rotation of the wind up roll.

The invention further contemplates a window covering assembly comprising, in combination:

a) a window covering comprising:

i) first and second generally parallel spaced apart, longitudinally extending, sheer fabrics, each having one end and an opposite end, and ii) a plurality of longitudinally spaced, generally parallel, transversely extending vanes, fixedly secured to said first and second sheer fabrics to extend herebetween;

b) a horizontal guide track, a sliding carrier mounted in said horizontal guide track for movement therealong;

c) a first end rail connected to said slider, said first end rail hanging vertically from said sliding carrier and movable with said sliding carrier as said sliding carrier moves along said track, said first end rail being connected to one of said sheer fabrics;

d) a second end rail connected to the other sheer fabric at the end opposite window covering opposite said first end rail; and e) additional sliding carriers connected to the upper end of at least some of said vanes and slidable in said track.

In order that the invention will be fully understood, the following detailed description of preferred embodiments of the assembly of the invention is given below, reference being made to the accompanying drawings.

DETAILED DESCRIPTION OF THE PREFERRED EMBODIMENTS

Figure 1:
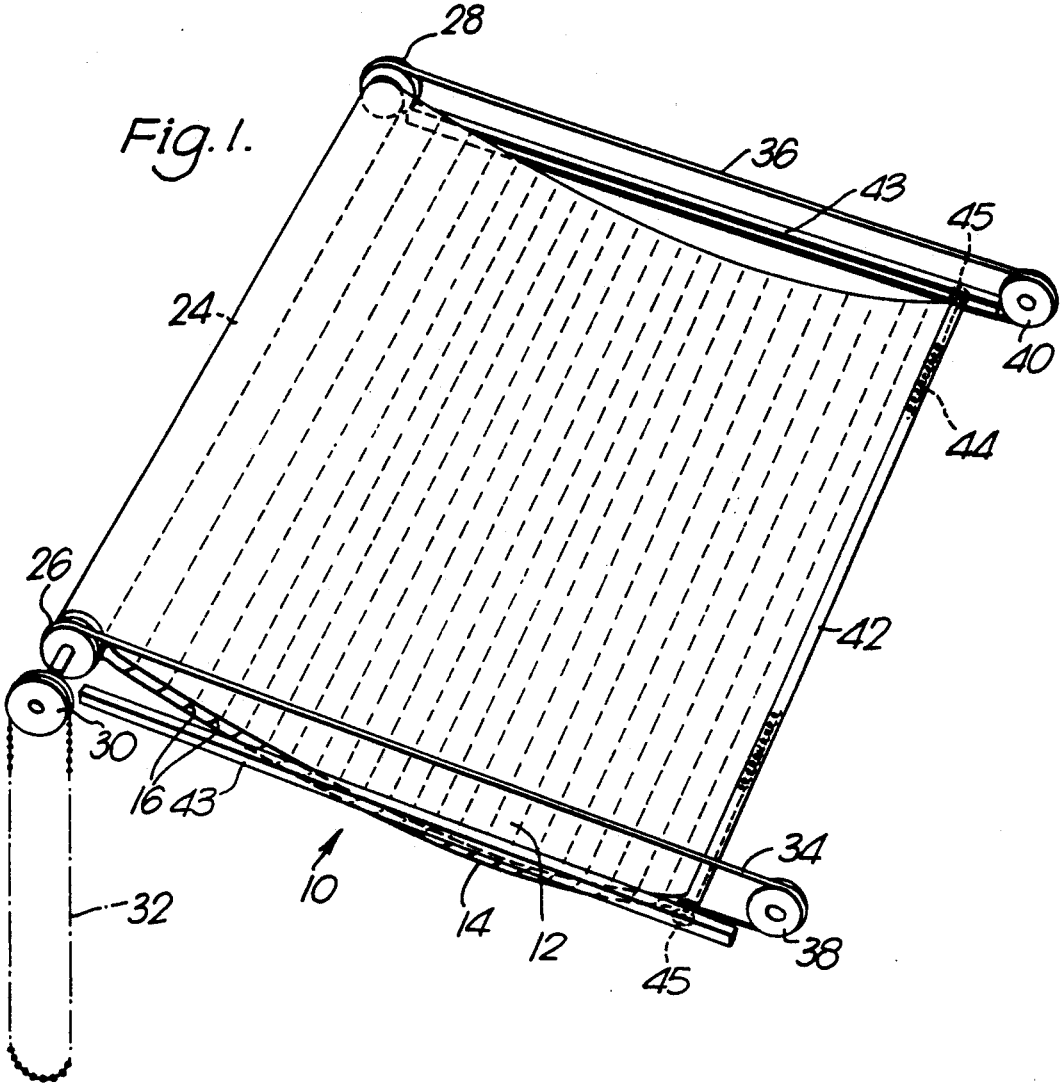
FIG. 1 is schematic perspective view of one embodiment of window covering assembly according to the invention.

In FIG. 1 there is illustrated a form of window covering suitable for covering a skylight in a horizontal or inclined roof.

The assembly includes a flexible window covering indicated by the general reference numeral 10 this including the first sheer fabric 12, a second sheer fabric 14 and a plurality of transversely extending vanes 16 extending therebetween, the vanes being generally parallel to one another. This window covering 10 can be made in a number of different ways which do not form part of the present invention. The sheer fabrics 12,14 are made of a translucent or transparent material such as paper, a woven fabric or non-woven fabric or indeed they can be made of a plastics material. Similarly the vanes 16 can be made of any suitable material. However, they are preferably formed of an opaque or semi-opaque material.

The sheer fabrics 12,14 are connected to circumferentially spaced apart fixing means 20,22 on a wind up roll 24 which is mounted with its longitudinal axis extending generally horizontally to one side of the frame of a skylight.

Associated with the roll 24, at each end thereof, are cord reels 26,28 and a control pulley 30 at the end adjacent the reel 26. Rotation of the wind up roll 24 can be effected by operation of a cord, for example a bead cord 32 wrapped around the control pulley 30. Alternatively a motor drive could be provided. This rotation is also imparted to the cord reels 26,28.

Wrapped around the cord reels 26,38 are tension cords 34,36 which also pass around fixed pulleys 38,40 and are connected to opposite ends of an end rail 42 having, in its interior, a tension spring 44 to the end of which are attached the ends of the tension cords 34,36. It is also possible as an alternative to replace the tension cords by a flat tension tape which is essentially thinner than the tension cord. This will decrease the layer on the cord reels 26,28 when the tape is rolled up. As can be seen more clearly in FIG. 2, the end rail 42 is attached to the second sheer fabric 14 only. Two parallel tracks 43 are provided, one on each side of the covering, the tracks extending generally perpendicular to the axes of the wind up roll 24 and the end rail 42, the tracks for example being of channel or L-cross-section. At each end of the rail 42 a runner 45 is mounted and is slidable longitudinally in the adjacent rack 43 and serves to guide and support the rail. If desired further runners (not shown) could be provided on some of the vanes 16, these also sliding in the tracks. It is also contemplated that the tracks 43 and runners 45 could be omittted, particularly on smaller installations.

Figure 2:
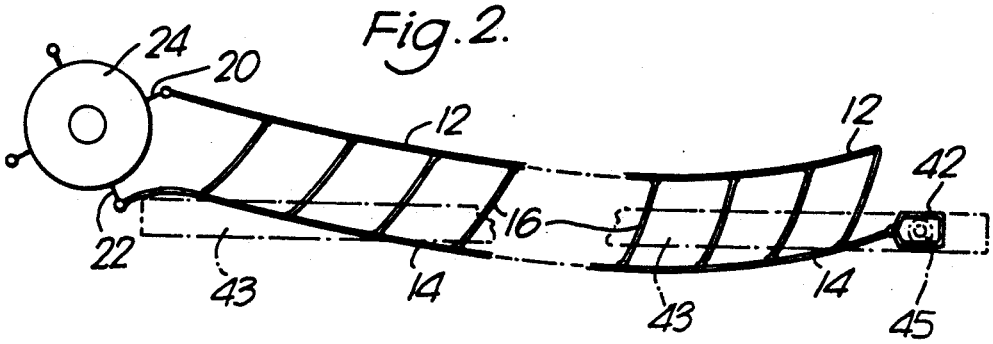
FIG. 2 is an enlarged cross-section showing the assembly of FIG. 1.

It will be understood that initial operation of the bead cord 32 will cause a certain rotation of the wind up roll 24. This will cause relative movement of the two sheer fabrics 12,14 with respect to one another in a direction parallel to one another. Thus the vanes will be caused to move from a position in which they extend in spaced apart relation, somewhat as shown in FIG. 2, in which light can readily pass therethrough, to a closed position in which they overlap each other thus blocking off the passage of light.

Further movement of the wind up 24 will cause both of the sheer fabrics 12,14, with the flattened and overlapping vanes 16 therebetween, to be wound up onto the roll 24. As this happens, the end rail 42 will move towards the wind up roll 24 so that the window covering can be pulled back by a desired distance and in fact can be pulled back completely.

If the bead chain 32 is operated in the opposite sense, then the cord reels will rotate in the opposite direction as will the wind up reel 24. The tension cords 34,36 will then tend to pull the end rail 42 back to the right as shown in FIG. 1, thereby drawing the window covering to cover the window.

Figure 3:
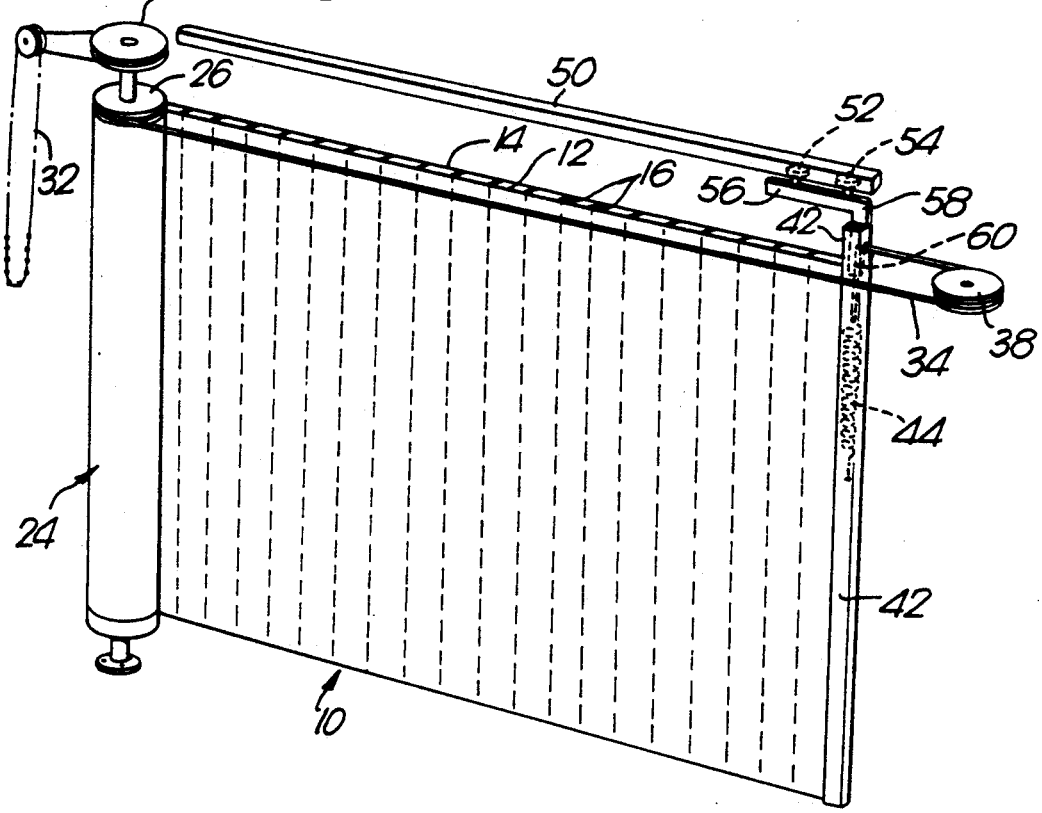
FIG. 3 is a view similar to FIG. 1 of a second embodiment.
Figure 4:
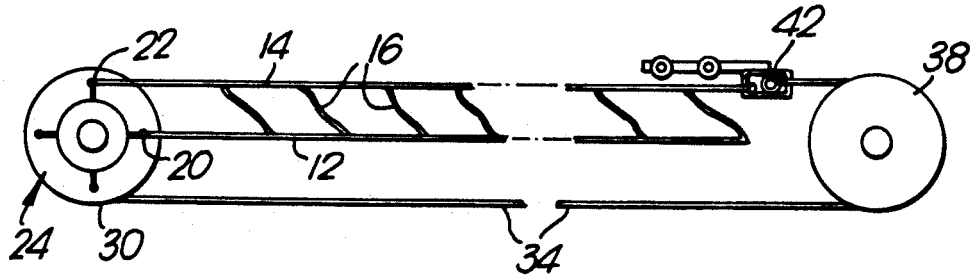
FIG. 4 is a view similar to FIG. 2 of the embodiment of FIG. 3.

The structure of FIGS. 3 and 4 is generally similar and like parts have been indicated by like reference numerals. In this structure, however, the wind up roll 24 and the end rail 42 are arranged vertically and there is only one cord reel 26 at the upper end. The cord 34 from this reel extends around the fixed pulley 38 and is attached to one end of the tension spring 44, the other end of which is secured internally in the end rail 42.

The lower end of the wind up roll 24 can be fixed to the floor or to a location below a window.

Extending generally horizontally above the window covering 10 is a horizontal track 50 in which are horizontally movable two sliding carriers 52,54 which are attached to one arm 56 of the right angled bracket 58 having a second, lower arm 60 secured to the end rail 42 so that the latter can hang downwardly and be supported by the sliding carriers 52,54 in the track 50. The lower end of the end rail 42 is not secured although it could be guided in a further track at the bottom.

Operation is effected in a similar manner to that of FIGS. 1 and 2 insofar as initial movement of the wind up roll 24 will affect the change of the relative angles of the slats 16 to the sheer fabrics 12,14 and further movement will cause the covering 10 to wind up on the roll 24. As it is rolled up, the sliding carriers 52,54 will slide along the track 50 carrying the end rail 42 with them.

If the roll 24 is operated in the opposite sense, then the end rail 42 will be pulled back by the tension cord 34 as before.

Figure 5:
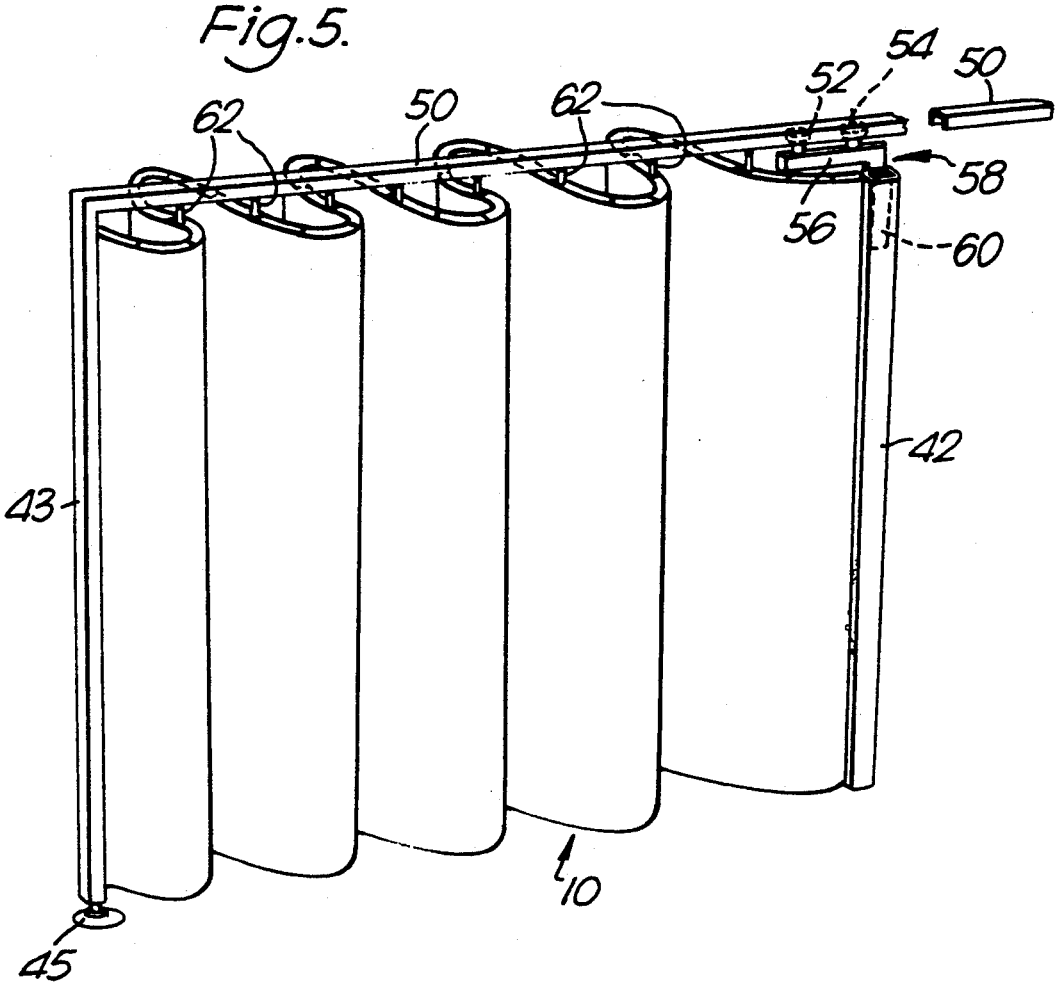
FIG. 5 is a view similar to FIG. 1 of a still further embodiment of window covering assembly according to the invention.
Figure 6:
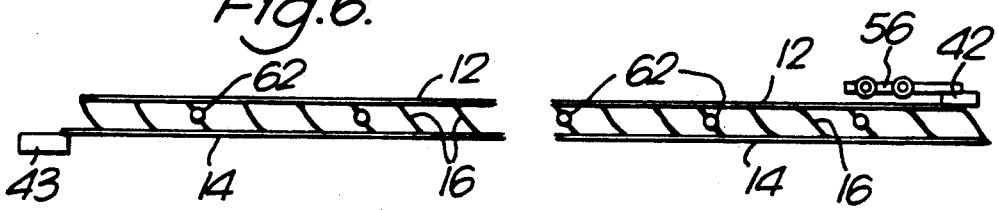
FIG. 6 is a top view of the window covering shown in FIG. 5, in the stretched state.

Referring now to FIGS. 5 and 6, a window covering is shown which has some similarities to the window covering of FIG. 3 and 4 except that there is no wind up roll. In this arrangement, there is again a window covering 10 formed in the same manner with two sheer fabrics 12,14 and vanes 16. Secured to the sheer fabric 12 at one end thereof is a first end rail 42 and secured to the other end of the second sheer fabric 14 is a second end rail 43.

Extending above the window covering 10 is a horizontal track 50. The first end rail 42 is mounted in a similar manner to that of FIG. 3, namely there is a bracket 58 of the first arm 56 associated with two sliding carriers 52,54 slidable in the track 50. Again, the lower end of the head rail 42 is shown as not riding in a track but it is conceived that it could ride in a lower track similar to upper track 50. In this structure there is no provision of a tension spring.

Some, but not all, of the vanes 16 are provided with runners 62. In the construction shown every third vane 16 is provided with a runner 62. This may be in the form of a plastics material plate having an upwardly extending pin with a head on it, which rides in the track 50.

The second end rail 43 is preferably fixed, e.g. as at 45 to the floor.

It will be appreciated that if one grasps the first end rail 42 and moves it to the left, then the covering 10 will concertina up in the manner indicated and will draw back in the manner similar to that of a curtain. If one pulls the end rail 42 to the right then it will stretch out so that the window covering 10 is as shown in FIG. 6. Further movement of the end rail 42 will cause deflection of the vanes 16 to provide more or less passage for light through the covering.

We claim:

1. A window covering assembly comprising in combination a window covering comprising first and second generally parallel spaced apart, longitudinally extending, sheer fabric sheets each defining parallel ends and parallel edges normal to said ends with juxtaposed ends of said sheets extending in spaced parallel relation, a plurality of longitudinally spaced, generally parallel, transversely extending vanes fixedly secured intermediate said first and second sheets and extending parallel to said sheet ends between the edges thereof, an end rail connected to one end of said second sheet and extending parallel to said vanes, a wind-u roll rotatable about its longitudinal axis and extending parallel to said end rail, means on said wind-up roll fixedly securing thereto juxtaposed ends of said sheets opposite said end rail in circumferentially spaced longitudinally extending relation thereon, said end rail being movable towards and away from said wind-up roll as said roll is rotated to wind or unwind said sheets, limited rotation of said wind-up roll when said sheets are fully extended causing said first and second sheets to move longitudinally relative to one another thereby to alter then angle of said vanes relative to said sheets.

2. A window covering assembly as defined in claim 1, wherein said wind-up roll and said end rail extend in spaced, generally parallel relation in a non-vertical plane.

3. A window covering assembly as defined in claim 1, wherein said end rail is spaced from the end of said first sheet corresponding to said one end of said second sheet.

4. A window covering assembly as defined in claim 1, further comprising a cord reel carried by said wind-up roll, a fixed pulley positioned beyond said end rail when said end rail is furthest from said wind-up roll, a flexible tension member connected to said cord reel and adapted to be wound thereon when said wind-up roll is rotated to extend said window covering, and unwound therefrom when said wind-up roll is rotated to wind said window covering, said tension member passing over said fixed pulley and connected to said end rail, and means for applying tension to said tension member.

5. A window covering assembly as claimed in claim 4, wherein said tension applying means comprises a tension spring located in said end rail.

6. A window covering assembly as defined in claim 1, further comprising means mounting said wind-up roll and said end rail in generally horizontally extending relation, first and second cord reels carried at opposite ends of said wind-up roll, first and second pulleys positioned beyond the ends of said end rail when said end rail is spaced furthest from said wind-up roll, first and second flexible tension members connected to said first and second cord reels respectively and windable thereon when said wind-up roll is rotated to extend said window covering and unwound therefrom when said wind-up roll is rotated to wind said window covering thereon, said first and second tension members passing over said first and second fixed pulleys and connected to opposite ends of said end rail, and means for applying tension to said tension members.

7. A window covering as defined in claim 6, wherein said tension applying means comprises a tension spring in said end rail having opposite ends secured respectively to said first and second tension members.

8. A window covering as defined in claim 6, further comprising means for rotating said wind-up roll from a remote location.

9. A window covering as defined in claim 1, further comprising two spaced apart parallel tracks extending generally perpendicular to said wind-up roll and said end rail, and runners on said end rail guided for longitudinal movement in said tracks for guiding and supporting said end rail.

10. A window covering assembly comprising in combination a window covering comprising first and second generally parallel spaced apart, longitudinally extending, sheer fabric sheets each defining parallel ends and parallel edges normal to said ends with juxtaposed ends of said sheets extending in spaced parallel relation, a plurality of longitudinally spaced, generally parallel, transversely extending vanes fixedly secured intermediate said first and second sheets and extending parallel to said sheet ends between the edges thereof, a generally horizontal end rail connected to one end of said second sheet and extending parallel to said vanes, a generally horizontal wind-up roll rotatable about its longitudinal axis and extending parallel to said end rail, means on said wind-up roll fixedly securing thereto juxtaposed ends of said sheets opposite said end rail in circumferentially spaced longitudinally extending relation thereon, said end rail being movable towards and away from said wind-up roll as said roll is rotated to wind or unwind said sheets, limited rotation of said wind-up roll when said sheets are fully extended causing said first and second sheets to move longitudinally relative to one another thereby to alter the angle of said vanes relative to said sheets.

11. A window covering assembly comprising in combination a window covering comprising first and second generally parallel spaced apart, longitudinally extending, sheer fabric sheets each defining parallel ends and parallel edges normal to said ends with juxtaposed ends of said sheets extending in spaced parallel relation, a plurality of longitudinally spaced, generally parallel, transversely extending vanes fixedly secured intermediate said first and second sheets and extending parallel to said sheet ends between the edges thereof, an end rail connected to one end of said second sheet and extending parallel to said vanes, a wind-up roll rotatable about its longitudinal axis and extending parallel to said end rail, means on said wind-up roll fixedly securing thereto juxtaposed ends of said sheets opposite said end rail in circumferentially spaced longitudinally extending relation thereon, said end rail being movable towards and away from said wind-up roll as said roll is rotated to wind or unwind said sheets, limited rotation of said wind-up roll when said sheets are fully extended causing said first and second sheets to move longitudinally relative to one another thereby to alter the angle of said vanes relative to said sheets, a cord reel carried by said wind-up roll, a fixed pulley positioned beyond said end rail when said end rail is furthest from said wind-up roll, a flexible tension member connected to said cord reel and adapted to be wound thereon when said wind-up roll is rotated to extend said window covering, and unwound therefrom when said wind-up roll is rotated to wind said window covering, said tension member passing over said fixed pulley and connected to said end rail, and means for applying tension to said tension member.

12. A window covering assembly comprising in combination a window covering comprising first and second generally parallel spaced apart, longitudinally extending, sheer fabric sheets each defining parallel ends and parallel edges normal to said ends with juxtaposed ends of said sheets extending in spaced parallel relation, a plurality of longitudinally spaced, generally parallel, transversely extending vanes fixedly secured intermediate said first and second sheets and extending parallel to said sheet ends between the edges thereof, an end rail connected to one end of said second sheet and extending parallel to said vanes, a wind-up roll rotatable about its longitudinal axis and extending parallel to said end rail, means on said wind-up roll fixedly securing thereto juxtaposed ends of said sheets opposite said end rail in circumferentially spaced longitudinally extending relation thereon, said end rail being movable towards and away from said wind-up roll as said roll is rotated to wind or unwind said sheets, limited rotation of said wind-up roll when said sheets are fully extended causing said first and second sheets to move longitudinally relative to one another thereby to alter the angle of said vanes relative to said sheets, means mounting said wind-up roll and said end rail in generally horizontally extending relation, first and second cord reels carried at opposite ends of said wind-up roll, first and second pulleys positioned beyond the ends of said end rail when said end rail is spaced furthest from said wind-up roll, first and second flexible tension members connected to said first and second cord reels respectively and windable thereon when said wind-up roll is rotated to extend said window covering and unwound therefrom when said wind-up roll is rotated to wind said window covering thereon, said first and second tension members passing over said first and second fixed pulleys and connected to opposite ends of said end rails, and means for applying tension to said tension members.

13. A window covering as defining in claim 12, wherein said tension applying means comprises a tension spring in said end rail having opposite ends secured respectively to said first and second tension members.

14. A window covering as defined in claim 12, further comprising means for rotating said wind-up roll from a remote location.

15. A window covering as defined in claim 12, further comprising two spaced apart parallel tracks extending generally perpendicular to said wind-up roll and said end rail, and runners on said end rail guided for longitudinal movement in said tracks for guiding and supporting said end rail.

* * * * *